US009194047B2

(12) United States Patent
Tettamanti et al.

(10) Patent No.: US 9,194,047 B2
(45) Date of Patent: Nov. 24, 2015

(54) ANODE FOR CATHODIC PROTECTION

(75) Inventors: Michele Tettamanti, Villaguardia (IT); Simone Tremolada, Monza (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 629 days.

(21) Appl. No.: 12/906,379

(22) Filed: Oct. 18, 2010

(65) Prior Publication Data

US 2011/0024286 A1 Feb. 3, 2011

Related U.S. Application Data

(63) Continuation of application No. PCT/EP2009/053958, filed on Apr. 2, 2009.

(30) Foreign Application Priority Data

Apr. 18, 2008 (IT) ..... MI2008A0714

(51) Int. Cl.
*C23F 13/18* (2006.01)
*C23F 13/10* (2006.01)

(52) U.S. Cl.
CPC ..... *C23F 13/18* (2013.01); *C23F 13/10* (2013.01); *C23F 2201/02* (2013.01)

(58) Field of Classification Search
CPC ..... C23F 13/10; C23F 13/18; C23F 2201/02
USPC ..... 204/196.18, 196.19, 196.2, 196.21, 204/196.33, 196.36; 205/734
See application file for complete search history.

(56) References Cited

U.S. PATENT DOCUMENTS 5,569,526 A * 10/1996 Tettamanti et al. ..... 204/196.3

FOREIGN PATENT DOCUMENTS

| | | | |
|---|---|---|---|
| CA | 2018869 | * | 1/1991 |
| EP | 0407348 | A1 | 1/1991 |
| EP | 0534392 | A1 | 3/1993 |
| EP | 0560452 | A1 | 9/1993 |

OTHER PUBLICATIONS

International Search Report for Application No. PCT/EP2009/053958 dated Feb. 4, 2009, 3 pages.

* cited by examiner

*Primary Examiner* — Luan Van
*Assistant Examiner* — Maris R Kessel
(74) *Attorney, Agent, or Firm* — Lucas & Mercanti, LLP

(57) ABSTRACT

The invention relates to an anode for cathodic protection in form of strip with a catalyst-coated metal part continuously integral with an insulating element of polymer material. The activated metal part and the insulating material can be arranged on opposite faces of the strip, or the insulating element can consist of two rails accommodating the edges of the metal part. The insulating element can be painted with a colored or luminescent pigment to favor its identification and facilitate the putting in place of the anode.

10 Claims, 4 Drawing Sheets

ANODE FOR CATHODIC PROTECTION

CROSS-REFERENCE TO RELATED APPLICATION

This application is a continuation of PCT/EP2009/053958 filed Apr. 2, 2009, that claims the benefit of the priority date of Italian Patent Application No. MI2008A000714 filed Apr. 18, 2008, the contents of which are herein incorporated by reference in their entirety.

FIELD OF THE INVENTION

The invention relates to an anode for cathodic protection of reinforced concrete structures.

BACKGROUND OF THE INVENTION

The corrosion phenomena affecting reinforced concrete structures are well known to the experts in the field. The steel reinforcement inserted in the cementitious structures to improve the mechanical properties thereof normally works in a passivation regime induced by the concrete alkaline environment; however, after some time, the ion migration across the porous surface of the concrete induces a localised attack to the protective passivation film. Another form of concrete decay is represented by the phenomenon of carbonatation, i.e. the formation of calcium carbonate by reaction of the lime in the cementitious mixture with atmospheric carbon dioxide. The calcium carbonate lowers the alkali content of the cement (from pH 13.5 to pH 9) bringing iron to an unprotected status. The most common method to extend the lifetime of reinforced concrete structures exposed to atmospheric agents consists of the cathodic polarisation of the steel reinforcement. In this way, the latter becomes the site of a cathodic oxygen reduction, thereby suppressing the corrosion and dissolution anodic reactions. This system, known as cathodic protection of reinforced concrete, is carried out by coupling anodic structures of various kinds to the concrete, in whose respect the reinforcement to be protected acts as the cathodic counterelectrode. The electrical currents involved, supplied by an external rectifier, transit across the electrolyte consisting of the porous concrete partially soaked with salty solution. It is known that the cathodic protection of a reinforcement cage may be achieved by means of a distributed anode system, for instance consisting of an arrangement of mesh strip anodes, installed on the reinforcement cage and electrically insulated from the metal by means of spacers made of plastic or cementitious material. The anode system is embedded into the structure during the construction, at the time of casting the concrete. A weak direct current (typically 1 to 30 mA per $m^2$ of reinforcement) applied to the anode and distributed across the whole structure imposes the cathodic potential required for the reinforcement protection.

The application of prefabricated insulating spacers of plastic or cementitious material to valve metal anodes in form of mesh strips has been disclosed in which the spacers are generally secured in a first step to the metal cage to be protected. The anode strips are subsequently secured to the spacers, for instance by insertion in appropriate slits provided in the spacers. Alternatively, the step of securing the anode strips to the spacers may be carried out by way of pins, bolts or clips, or by using adhesives. This operation is apparently lengthy and cumbersome, especially in those spots offering a less comfortable installation due to a difficult access or to an insufficient lighting. This operation also presents a certain risk of error, because an accidental mistake in the positioning or in the fixing step may cause the anode strip to be locally put in electrical contact with the metal reinforcement cage.

Another kind of discrete spacer for anode strips employed in the cathodic protection of reinforced concrete has been disclosed wherein parallelepipeds of cementitious material with embedded insulating fibres, obtained by moulding, are positioned on the structure to be protected before laying down the anodes. Also in this case, the overall operation appears laborious, scarcely practical in zones of difficult access and not exempt from risks of error. The cementitious spacer is stiff and has a predefined length, which limits its use to not-too-complex structures.

SUMMARY OF THE INVENTION

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, the invention comprises, under one aspect an anode for cathodic protection in the form of a prefabricated composite strip comprising a conductive element coupled to an insulating polymer element continuously integral therewith, the conductive element comprising a metal substrate provided with a superficial catalytic coating To the accomplishment of the foregoing and related ends, the following description sets forth certain illustrative aspects and implementations. These are indicative of but a few of the various ways in which one or more aspects may be employed. Other aspects, advantages, and novel features of the disclosure will become apparent from the following detailed description.

DETAILED DESCRIPTION OF THE DRAWINGS

Figure 1A:
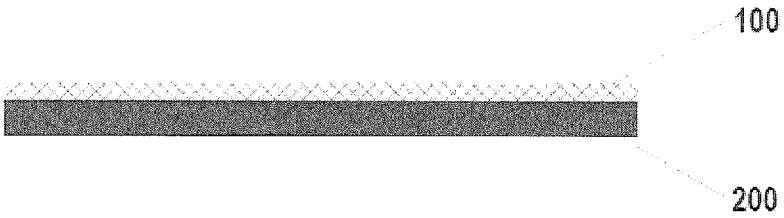
FIG. 1 illustrates a cross-section of one embodiment of an anode in form of composite strip (FIG. 1A), a top-view of a segment of the insulating element alone (FIG. 1B) and a top-view of a segment of composite strip obtained by juxtaposition of the same insulating element with an anode mesh (FIG. 1C).

In one embodiment, the invention relates to an anode for cathodic protection in the form of a composite strip comprising a conductive element, such as a metal substrate provided with a superficial catalytic coating (activated element), and an insulating polymer element continuously integral therewith. The composite strip, optionally rolled into a coil, can thus be directly unwound or otherwise laid down on the metal cage to be protected with no need for a previous positioning of discrete spacers. The continuous coupling between the activated element and the insulating element minimises the risk of accidental contacts between the activated substrate and the metal reinforcement to be protected.

The composite strip can be prefabricated coupling the activated element and the polymer insulating element by co-lamination or mechanical interlocking, by insertion in a foldable structure or by any other fastening means.

In one embodiment, the metal substrate is a strip of mesh or of solid, punched or expanded sheet of titanium, provided with a superficial catalytic coating. The catalytic coating can contain noble metals, optionally in the form of oxides.

The insulating element can be manufactured by moulding starting from a polymer material of various types, for example polyethylene or polypropylene. In one embodiment, the insulating polymer element is a continuous strip equipped with a multiplicity of holes or openings. This can favour a suitable contact of the concrete, poured in a phase subsequent to the anode positioning, with the activated substrate. The openings may have different sizes and geometries, such as to prevent an excessive blinding of the activated substrate, according to the contingent needs.

In one embodiment, the insulating polymer element is a continuous strip provided with a multiplicity of holes or openings consisting of a foldable structure, suitable for housing the activated element in its interior and optionally equipped with fastening means to keep it in the folded position, the fastening means, for instance, consisting of removable articles such as push buttons, hooks, rivets, bolts or clips.

In another embodiment, the insulating polymer element comprises concave parts dimensioned so as to adapt to the profile of the reinforcement cage to be protected. For instance, each concave part may be arranged so as to match the corresponding bar of the reinforcement cage. This can contribute to hold the composite strip anodes in position during the phase of concrete casting, preventing them from sliding.

In another embodiment, the insulating polymer element is magnetic, which can also contribute to hold the composite strip anodes in position during the phase of concrete casting and prevent them from sliding.

In another embodiment, the insulating polymer element comprises a pair of rails or guides suitable for accommodating or enclosing the edges or the activated element. In this way the resulting composite strip is free of cutting edges, thereby facilitating the handling and positioning thereof.

In another embodiment, the insulating polymer element comprises a continuous polymer strip provided with a multiplicity of holes or openings juxtaposed to the activated element, and a pair of rails suitable for accommodating or enclosing the activated element and the continuous polymer strip juxtaposed thereto.

In another embodiment, the insulating polymer element comprises a coloured pigmentation, which can help its identification at first glance from the activated metal part. In another embodiment, the insulating polymer element comprises a luminescent pigmentation, for instance phosphorescent, fluorescent or bioluminescent. The use of coloured or luminescent pigmentations can be particularly helpful for the installation in poorly lighted spots, allowing to verify more easily the overall alignment of the cathodic protection system, for example in correspondence to the exposed areas or of junction zones of the reinforcement cage.

In one embodiment, a cathodic protection system comprises one or more anodes in form of composite strip according to one of the above illustrated embodiments embedded in a reinforced concrete structure, wherein the composite anodes contact the bars of the reinforcement cage only with the polymer insulating part, the exposed parts of the activated metal substrate being entirely surrounded by concrete.

Figure 1B:
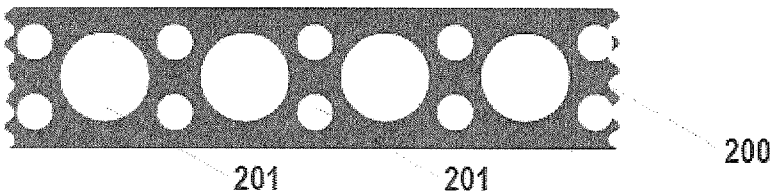
Figure 1C:
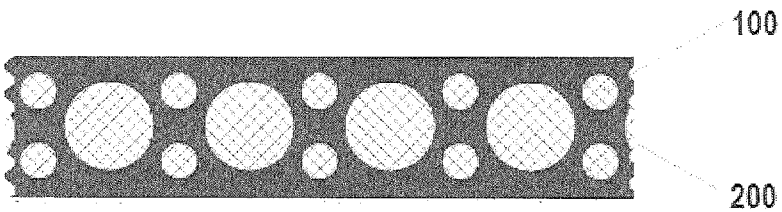

An example of an anode for cathodic protection in the form of composite strip, as shown in FIG. 1, is obtained by integral continuous juxtaposition of a conductive element consisting of an activated anode mesh (100) to an insulating polymer element (200) along their whole length. The juxtaposition of the two elements is well visible in FIG. 1A, showing a cross-section view. As it is shown in the top-view of FIG. 1B, the insulating polymer element (200) is equipped with suitable holes (201) of different diameter, in order to diminish the anode mesh blinding effect. FIG. 1C is a top-view of the composite strip as seen from the insulating polymer element (200) side, across whose holes the activated anode mesh (100) is visible.

Figure 2A:
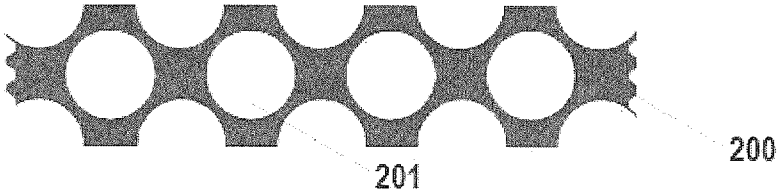
FIG. 2 illustrates a top-view of another embodiment of insulating element (FIG. 2A) and a top-view of a segment of composite strip obtained by juxtaposition of the same insulating element with an anode mesh (FIG. 2B).
Figure 2B:
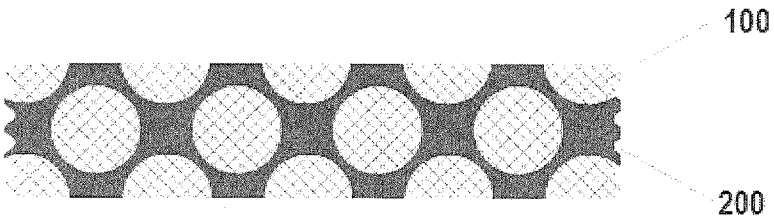

FIG. 2 shows another embodiment of anode for cathodic protection in the form of a composite strip, analogous to the one of FIG. 1 but with a different hole arrangement. FIG. 2A shows the insulating polymer element (200) equipped with holes (201) alone, according to a top-view, analogouy to FIG. 1B, while FIG. 2B shows a top-view of the composite strip as seen from the insulating polymer element (200) side, across whose holes the activated anode mesh (100) is visible, analogously to FIG. 1C.

Figures 3A, 3B:
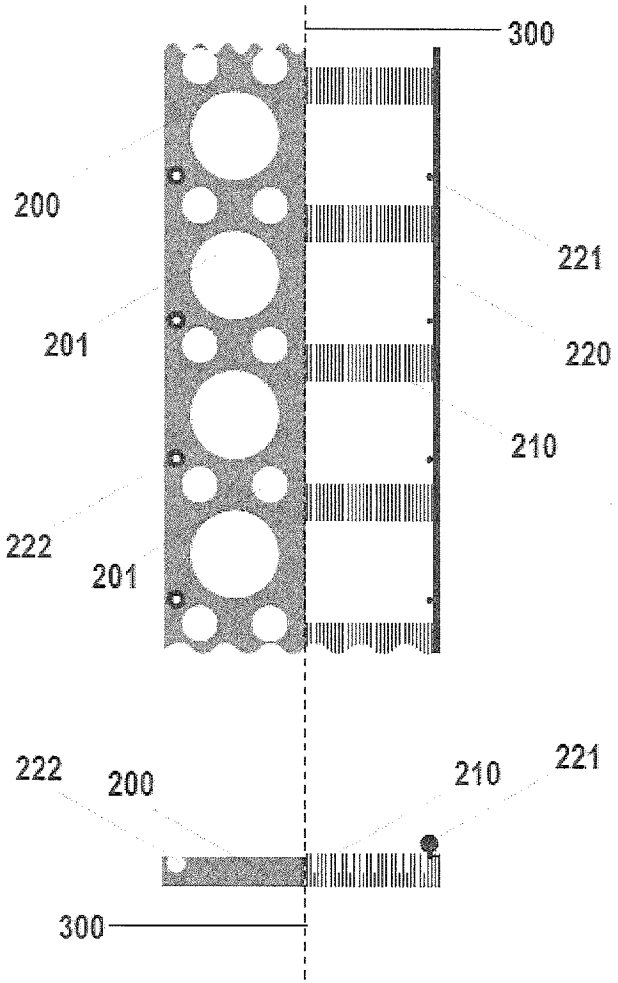
FIG. 3 illustrates a top-view of a segment of another embodiment of insulating element consisting of a foldable element (FIG. 3A) and the relevant cross-section (FIG. 3B).

FIG. 3 shows another embodiment of insulating polymer element for composite strip anode. In particular, FIG. 3A is a top-view of an insulating polymer element consisting of a foldable structure, and FIG. 3B is the corresponding cross-section view. The insulating element (200) comprises a polymer strip equipped with suitable holes (201) and an assembly of insulating ribbons (210), optionally knurled and provided with a coloured or luminescent pigmentation, integral with the polymer strip and fixed to a rigid edge (220) in a mutually parallel arrangement. On the rigid edge (220), fastening means are arranged, for instance consisting of a multiplicity of push buttons (221) suitable for cooperating with a multiplicity of seats (222) upon folding the insulating element along its longitudinal axis (300) after insertion of the activated element (not shown). This embodiment can have the advantage of allowing the continuous fixing of the activated element to the insulating polymer element by aid of a simple mechanical assemblage operation. The use of knurled ribbons can contribute keeping the anode in position during the concrete casting. The ribbon pigmentation as described can help reduce costs by allowing an easier and safer positioning without having to resort to the pigmentation of the whole insulating element.

Figure 4:
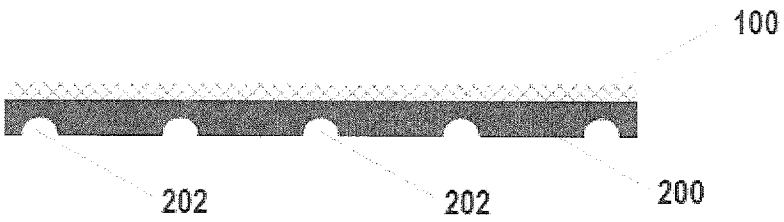
FIG. 4 illustrates a cross-section of another embodiment of anode in form of composite strip comprising an insulating element provided with concave parts.

FIG. 4 is another embodiment of an anode for cathodic protection in the form of composite strip shown in a cross-section in analogy with FIG. 1A. Also in this case, the anode is obtained by integral continuous juxtaposition of a conductive element consisting of an activated anode mesh (100) to an insulating polymer element (200) along their whole length. Additionally, the insulating polymer element (200) is provided with concave parts (202) suitable for matching the profile of the reinforcement bars of an armed concrete structure.

Figure 5:
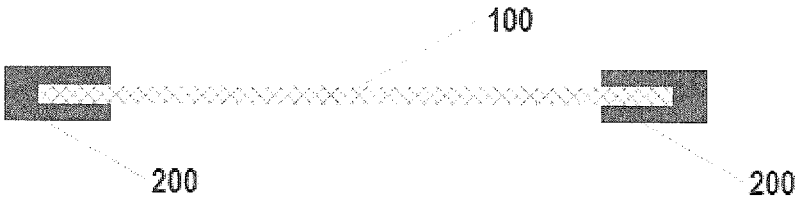
FIG. 5 illustrates a cross-section of another embodiment of anode in form of composite strip comprising an insulating element comprising a pair of rails.

FIG. 5 shows a cross-section view of a different embodiment of anode for cathodic protection in form of composite strip. In this case, the insulating polymer element (200) consists of a pair of rails in whose interior the activated anode mesh (100) is inserted.

Although a number of particular embodiments were illustrated, a person of skill in the art will appreciate the possibility of introducing changes to such embodiments or to conceive different embodiments without departing from the scopes of the invention.

For instance, while anodes comprising polymer elements equipped with circular holes were depicted in the drawings, other examples may contemplate polymer elements having holes of different shapes, or polymer elements in form of mesh.

In the drawings there is also depicted by way of example an insulating polymer element consisting of a foldable structure equipped with a series of knurled ribbons and with fastening means for restraining the same in the folded position consisting of push buttons; in other embodiments, an insulating polymer element can consist of a foldable structure of different geometry or having different, optionally removable fastening means for restraining the same in the folded position.

In the drawings there is also depicted by way of example an anode comprising a polymer element provided with equally spaced concave parts; in other examples, the anode comprises polymer elements provided with concave parts with a different spacing, for instance in order to better adapt to particular reinforcement cage geometries.

The previous description shall not be intended as limiting the invention, which may be used according to different embodiments without departing from the scopes thereof, and whose extent is solely defined by the appended claims. Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Anode for cathodic protection, comprising a prefabricated composite strip comprising a conductive element co-laminated or mechanically interlocked to an insulating polymer element and continuously integral therewith, said conductive element comprising a metal substrate provided with a superficial catalytic coating, wherein the insulating polymer element comprises a pair of rails accommodating or enclosing the edges of said conductive element and a foldable structure suitable for accommodating the metal substrate in its interior.

2. The anode according to claim 1, the metal substrate comprising a titanium mesh or a solid, punched or expanded sheet and the catalyst comprising noble metals or oxides thereof.

3. The anode according to claim 1, wherein the metal substrate and the insulating polymer element are juxtaposed along their whole length and the insulating polymer element is equipped with a multiplicity of holes or openings.

4. The anode according to claim 1, wherein the foldable structure is provided with removable fastening means for keeping the same in the folded position.

5. The anode according to claim 1, wherein the insulating polymer element is equipped with a multiplicity of concave parts suitable for matching the profile of a multiplicity of reinforcement bars of an armed concrete structure.

6. The anode according to claim 1, wherein the insulating polymer element is colored or luminescent.

7. The anode according to claim 1, wherein the insulating polymer element is magnetic.

8. A cathodic protection system comprising at least one anode according to claim 1 embedded in a cementitious structure provided with metal reinforcement bars, the anode being in direct contact with the metal bars only in correspondence of an insulating polymer element.

9. Method of installation of a cathodic protection system comprising at least one anode according to claim 1 embedded in a cementitious structure provided with metal reinforcement bars, the anode being in direct contact with the metal bars only in correspondence of an insulating polymer element, the method comprising:

laying down an anode in the form of composite strip on a multiplicity of metal reinforcement bars putting the anode in contact with the bars only through an insulating polymer element, with optional housing of concave parts of the insulating polymer element in correspondence of the bars; and pouring of liquid concrete over the metal bars covered with the anode in form of strip and subsequent consolidation of the cementitious structure.

10. The method according to claim 9, wherein the step of laying down of the anode is carried out by unwinding the anode in form of strip rolled into a coil.

* * * * *